US007351117B1

(12) United States Patent
Mostoller et al.

(10) Patent No.: US 7,351,117 B1
(45) Date of Patent: Apr. 1, 2008

(54) ELECTRICAL CONNECTOR ASSEMBLY HAVING PRE-STAGING AND FINAL STAGING CONTACT CONFIGURATIONS

(75) Inventors: Matthew E. Mostoller, Hummelstown, PA (US); William Gary Lenker, Marysville, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/556,727

(22) Filed: Nov. 6, 2006

(51) Int. Cl.
*H01R 13/428* (2006.01)

(52) U.S. Cl. ..... 439/744

(58) Field of Classification Search ..... 439/599, 439/86, 380, 724, 744, 752
See application file for complete search history.

(56) References Cited

U.S. PATENT DOCUMENTS 4,443,048 A * 4/1984 Moist, Jr. ..... 439/599
4,544,220 A 10/1985 Aiello et al.
5,425,661 A 6/1995 Self, Jr. et al.
5,443,403 A 8/1995 Weidler et al.
5,496,194 A 3/1996 Huss, Jr.
6,007,362 A 12/1999 Davis et al.
6,716,069 B2 * 4/2004 Nakamura et al. ..... 439/752
6,793,513 B2 * 9/2004 Shibata ..... 439/271
7,033,201 B2 * 4/2006 Ichida et al. ..... 439/352
7,114,983 B2 * 10/2006 Fukatsu et al. ..... 439/358
2004/0005805 A1 * 1/2004 Shibata ..... 439/358

* cited by examiner

*Primary Examiner*—Chandrika Prasad

(57) ABSTRACT

An electrical connector assembly for a refrigerator door is disclosed. The connector assembly includes a substantially cylindrical plug subassembly and a substantially cylindrical receptacle subassembly that are mateably connectable with one another. Either one or both of the plug and receptacle subassemblies include a front and a rear housing that can be arranged to provide a pre-staging configuration for preassembly of contacts in the connector and a final staging configuration to fully secure the contacts in the subassembly.

20 Claims, 8 Drawing Sheets

ELECTRICAL CONNECTOR ASSEMBLY HAVING PRE-STAGING AND FINAL STAGING CONTACT CONFIGURATIONS

FIELD OF THE INVENTION

This invention relates generally to the field of electrical connectors and, more particularly, to an electrical connector assembly particularly suitable for use in a refrigerator door.

BACKGROUND OF THE INVENTION

The doors of present day refrigerators are more than mere closures for the interior of the refrigerator. Such doors are increasingly being equipped with electrical and electronic components such as, for example, control panels, ice dispensers, cold water taps, and the like. Accordingly, electrical cabling (e.g., a wire harness) must be provided to the door from the main body of the refrigerator in order to allow the transmission of electrical power and control signals between the door and the main body. For aesthetic and safety purposes, such cabling should not be allowed to loosely drape along its path of travel, but instead should be closely held. It is common to route such cabling, as part of its path of travel, through a hollow hinge pin of the refrigerator door. In the past, the cabling has been routed through the hinge pin and then a connector has subsequently been installed at the distal end of the cabling for later engagement with a mating connector on cabling from the main refrigerator body. However, installing the connector at the end of the cabling during the final assembly of the refrigerator is not an easy task.

One solution is proposed in U.S. Pat. No. 6,007,362 to Davis et al. that discloses a connector assembly that can be installed on cabling before the cabling is connected to various components within the refrigerator door and thereafter have the cabling, with the connector attached, installed through the hollow hinge pin for subsequent connection with a mating connector on cabling from the refrigerator body.

However, continuing innovations in refrigerator doors, as well as methods for their manufacture and use, may subject the connectors, exposed contacts, and the wires they contain to significant torsional strains, which may in some cases subject the contacts to damage or cause the wires to twist free of the contacts.

Furthermore, connectors are often used to terminate multiple wires and it is important that the person assembling the connector ensures that each wire matches up with a corresponding wire to properly complete a circuit. However, current connector solutions for use in these applications lock the wires and their respective contacts into connector pieces without an opportunity to first review the wire alignment. Thus, errors typically cannot be corrected without breaking the connector and re-stripping and re-terminating the wire or without requiring the use of special tools.

What is needed is an electrical connector system that permits technicians to verify proper wire alignment before locking wires and contacts into a final position, while also protecting the contacts from damage prior to connection, such as permitting a greater range of twisting of the wires to reduce torsional strains.

SUMMARY OF THE INVENTION

According to one embodiment of the invention, a connector assembly is disclosed. The connector assembly comprises a substantially cylindrical plug subassembly having a front plug housing and a rear plug housing, the front plug housing and the rear plug housing positionable in a first staging configuration and a second staging configuration with respect to one another, a substantially cylindrical receptacle subassembly mateably connectable with the plug subassembly, and means for releaseably mating the plug and receptacle subassemblies to one another. The receptacle subassembly includes a common receptacle channel for receiving the plug subassembly, wherein a plurality of male contacts are disposed within the common receptacle channel. The plug subassembly includes a plurality of female contacts individually having a mating end positioned within separate plug channels, each female contact configured to connect with a corresponding male contact when the plug and receptacle are mateably connected and wherein the plug is sized and dimensioned to fit through a refrigerator door hinge.

According to another embodiment of the invention, a connector assembly comprises a substantially cylindrical plug subassembly, a substantially cylindrical receptacle subassembly mateably connectable with the plug subassembly having a front receptacle housing and a rear receptacle housing, the front receptacle housing and the rear receptacle housing positionable in a first staging configuration and a second staging configuration with respect to one another, and means for releaseably mating the plug and receptacle subassemblies to one another. The receptacle subassembly includes a common receptacle channel for receiving the plug subassembly, wherein a plurality of male contacts are disposed within the common receptacle channel. The plug subassembly includes a plurality of female contacts individually having a mating end positioned within separate plug channels, each female contact configured to connect with a corresponding male contact when the plug and receptacle are mateably connected and wherein the plug is sized and dimensioned to fit through a refrigerator door hinge.

One advantage of certain exemplary embodiments of the invention is that exposure of the electrical contacts of the plug is limited, the contacts disposed within the plug to avoid damage that may otherwise occur during assembly.

Another advantage of certain exemplary embodiments of the invention is that a two piece plug and/or receptacle can be used to pre-stage electrical contacts prior to final assembly.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
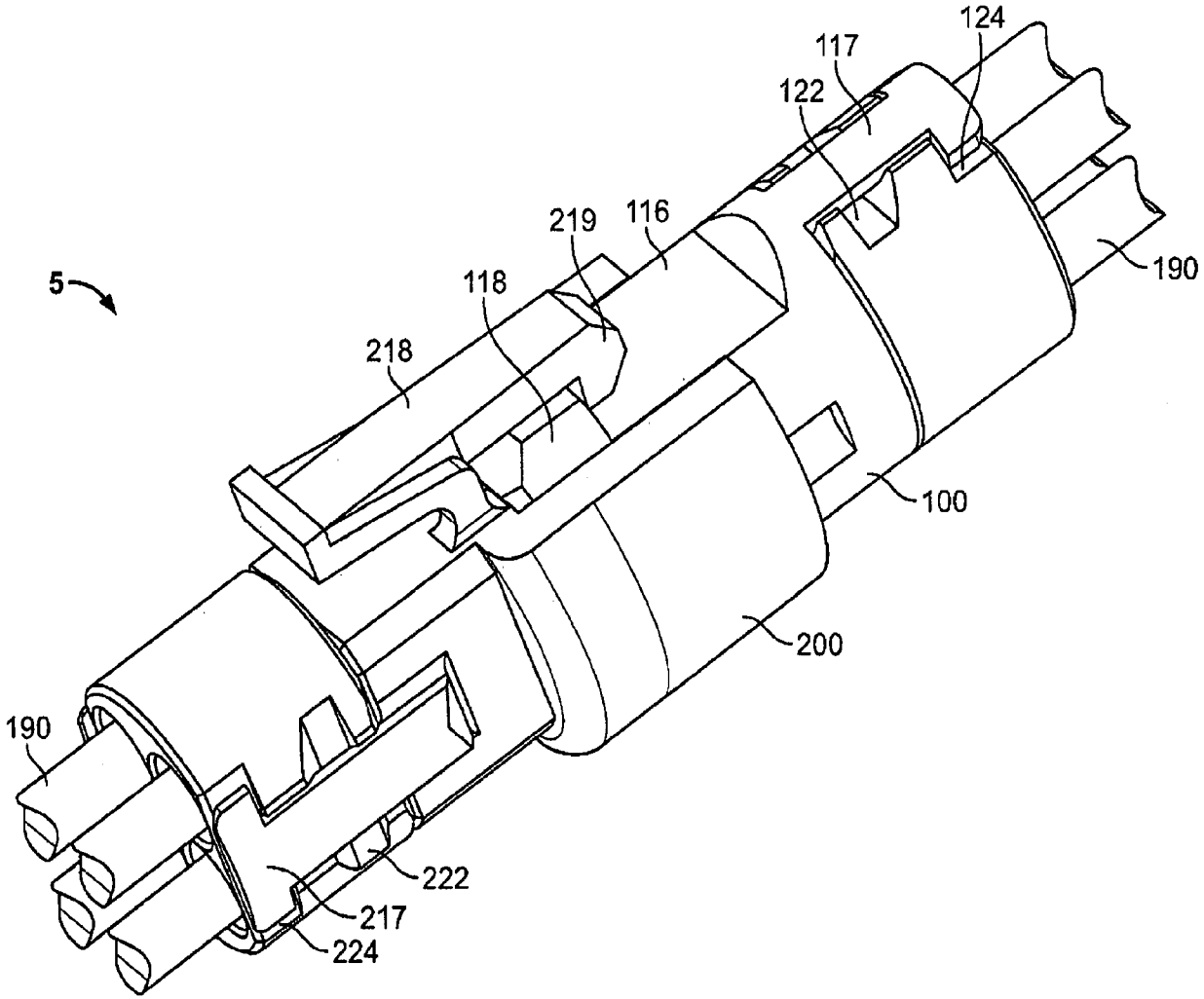
FIG. 1 illustrates a mated connector assembly in accordance with an exemplary embodiment of the invention.

FIG. 1 illustrates a mated connector assembly 5. The connector assembly 5 includes a plug subassembly 100 and a receptacle subassembly 200 releasably connectable to one another by a latch 218.

The connector assembly 5 is particularly suitable for use in refrigerator doors. The plug subassembly 100 may be used to terminate cables 190, such as electric wires extending from a water or ice station within a refrigerator door, while the receptacle subassembly 200 may then provide connection from the door to a central power source for the refrigerator. The plug subassembly 100 is sized so that it can be used to terminate the cables prior to final assembly, which generally requires that the plug subassembly 100 is dimensioned and of a suitable geometry to pass through a refrigerator door hinge. Preferably, the plug subassembly 100 is generally cylindrical to maximize the cross-sectional area of the plug available for wire management.

Figure 2:
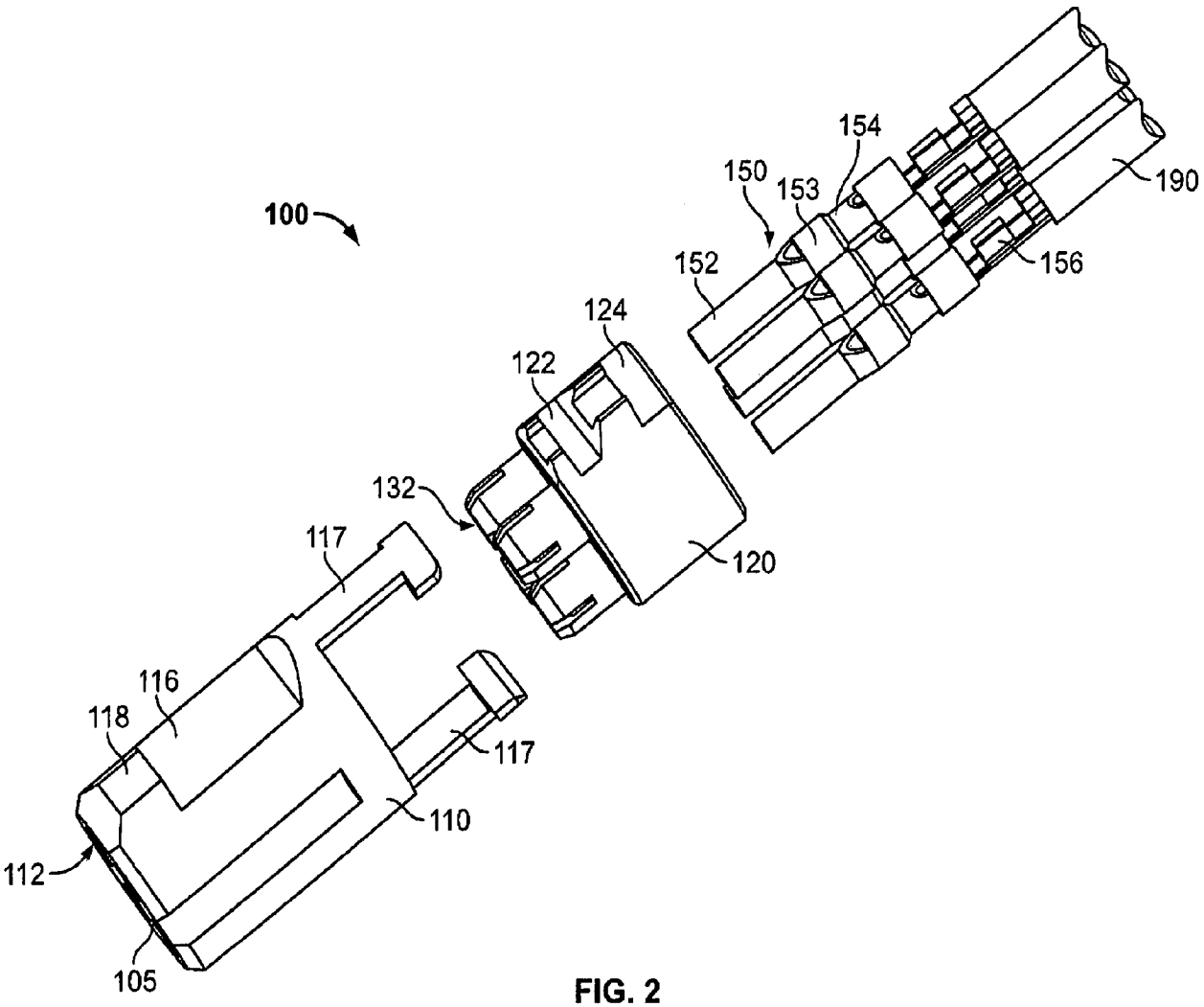
FIG. 2 illustrates an exploded view of a plug subassembly in accordance with an exemplary embodiment of the invention.
Figure 3:
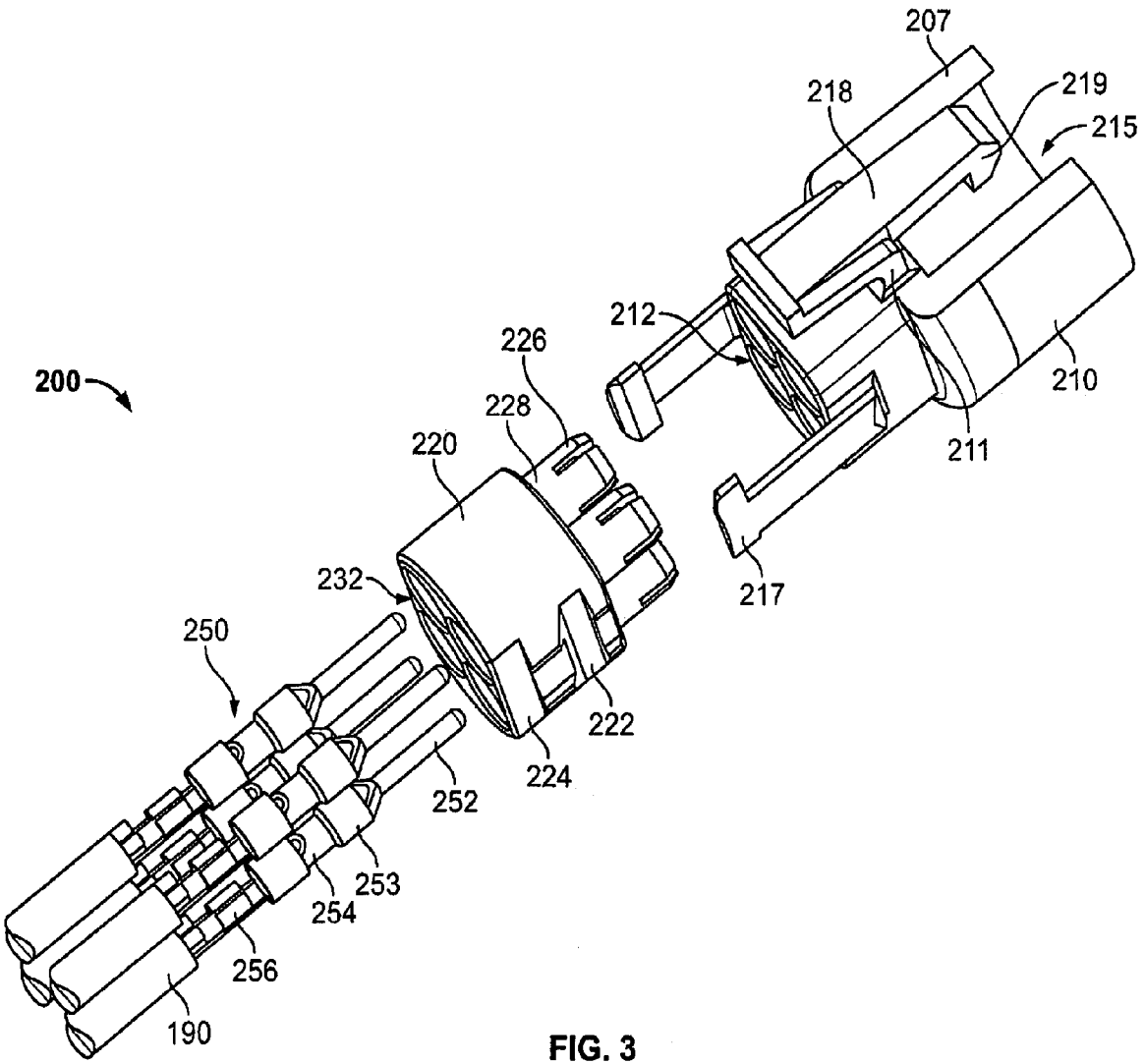
FIG. 3 illustrates an exploded view of a receptacle subassembly in accordance with an exemplary embodiment of the invention.

As shown in FIG. 2, the plug subassembly 100 includes a front plug housing 110, a rear plug housing 120, at least one conductive female contact 150, and an abutment 118. Similarly, as shown in FIG. 3, the receptacle subassembly 200 includes a front receptacle housing 210, a rear receptacle housing 220, at least one conductive male contact 250, and a latch 218.

Figure 7:
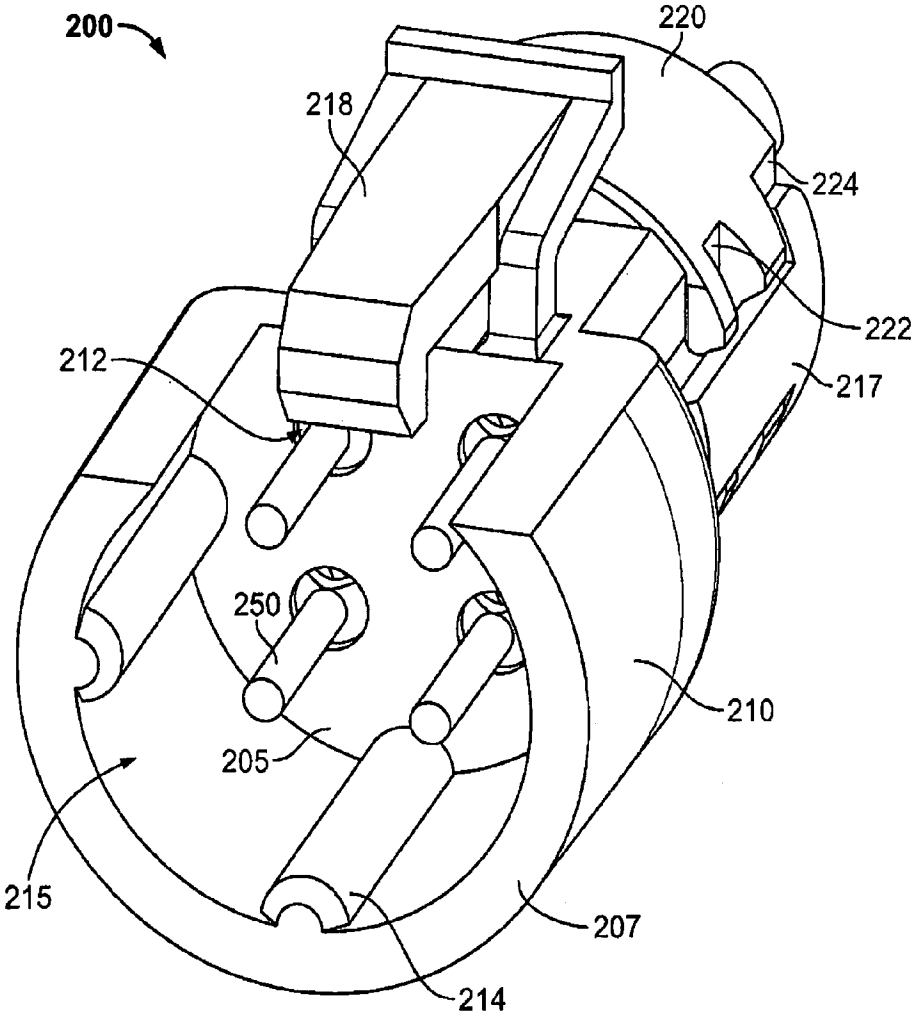
FIG. 7 illustrates a fully staged receptacle subassembly in accordance with an exemplary embodiment of the invention.

The front and rear receptacle housings 210, 220 are molded of an insulative material. As better seen in FIG. 7, the front receptacle housing 210 has a hollow, common plug-receiving channel 215 which is bounded at the rear by a receptacle mating face 205 and on the sides by a cylindrical wall 207. The channel 215 is sized and dimensioned to receive the plug subassembly 100. The cylindrical wall 207 is incomplete, subtending an arc greater than 180° and less than 360° so that there is a gap in the cylindrical wall 207. The male contacts 250 all extend into, but preferably not beyond, the common channel 215 are thus substantially protected from possible damage prior to connection with the plug subassembly 100 by the cylindrical wall 207.

Returning to FIG. 3, the latch 218 is preferably formed unitarily with the front receptacle housing 210 and extends forwardly away from the front receptacle housing 210 such that it is disposed over the gap in the cylindrical wall 207. The latch 218 includes a pedestal portion 211 extending radially outward from the front receptacle housing 210 and a hook portion 219 for engaging the abutment 118 of the plug subassembly 100. The pedestal portion 211 provides a pivot axis permitting the latch 218 to work as a simple lever. That is, the pedestal portion 211 provides a biasing force to keep the hook 219 engaged with the abutment 118 in the absence of an applied downward force, but when a downward force is applied to the latch 218 at an end opposite the hook portion 219, the hook portion 219 moves upwardly away from, and thus disengages, the abutment 118, permitting disconnection of the connector assembly 5.

The receptacle subassembly 200 includes a plurality of contact receiving apertures defined by front receptacle apertures 212 and rear receptacle apertures 232 that extend longitudinally through the entire receptacle subassembly 200 to individually receive a male contact 250. Each of the male contacts 250 is formed from a conductive material to have a pin section 252 for engaging a corresponding female contact 150 disposed in the plug subassembly 100, a head section 253 having a diameter greater than that of the pin section 252, and a neck section 254, having a diameter smaller than the head section 253, but greater than that of the pin section 252. The male contact 250 may also include a crimp section 256 for attaching a conductive wire, or wires, 190, as is conventional. One exemplary contact which may be used is the Mini-UML 2 from Tyco Electronics of Middletown, Pa.

Figure 8:
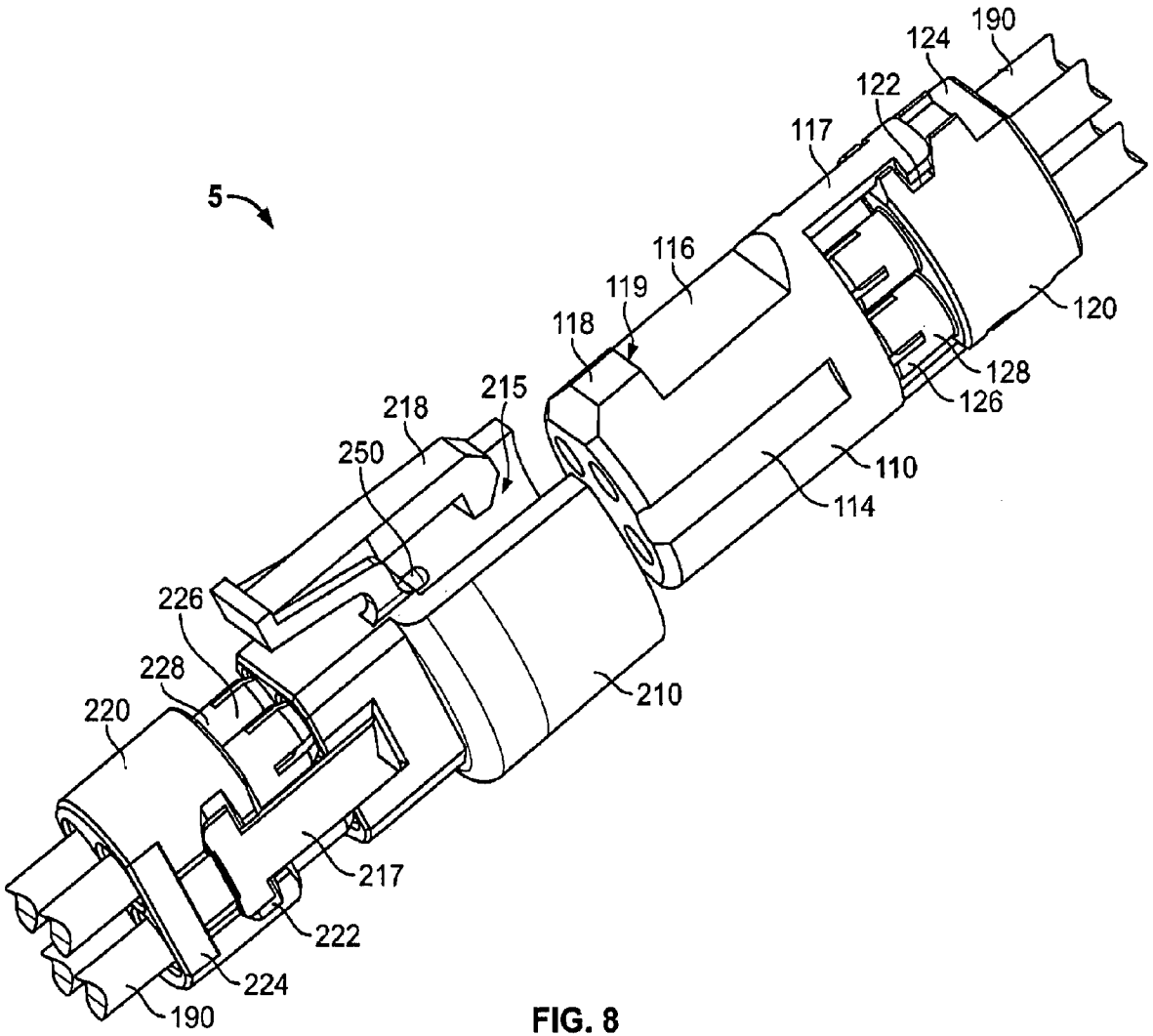
FIG. 8 illustrates an unmated, pre-staged connector assembly in accordance with an exemplary embodiment of the invention.

The front receptacle housing 210 includes two staging tabs 217 extending rearwardly away from the front receptacle housing 210 toward the rear receptacle housing 220. The rear receptacle housing 220 includes at least two staging pads 222, 224 associated with each staging tab 217 to establish a pre-staged and a fully staged configuration of the receptacle subassembly 200. The staging pads 222, 224 are typically formed by recesses molded into the surface of the rear receptacle housing 220. In the prestaged configuration (FIG. 8), the staging tabs 217 are retained in a pre-staging pad 222 of the rear receptacle housing 220. In this pre-staged positioned, corresponding wires 190 and the male contacts 250 used to terminate them can be positioned within appropriate receptacle apertures by first inserting them into the appropriate receptacle apertures.

The rear receptacle housing 220 includes a multi-fingered parapet 228 extending forwardly away from the rear receptacle housing 220 toward the front receptacle housing 210. The parapets 228 are sized and positioned to fit within the front receptacle apertures 212 of the front housing 210. Each parapet 228 includes multiple fingers 226 at least partially separated from one another at an original biased orientation.

In the pre-staged position, the terminated wires 190, each having its own male contact 250, are individually inserted through the rear receptacle housing 220 through separate rear receptacle apertures 232. The diameter of the head section 253 of the male contact 250 is wider than the outlet of the rear receptacle aperture 232 at the end of the parapet 228, typically about 10-40% wider and more typically about 25-35% wider.

As the contact 250 is inserted into and through its corresponding rear receptacle aperture 232, the fingers 226 of the parapet 228 are forced open by the head section 253 and against their biased position to accommodate the larger head section 253. Once through, the fingers 226 return to their original biased orientation and retract around the narrower neck section 254 of the male contact 250.

Figure 4:
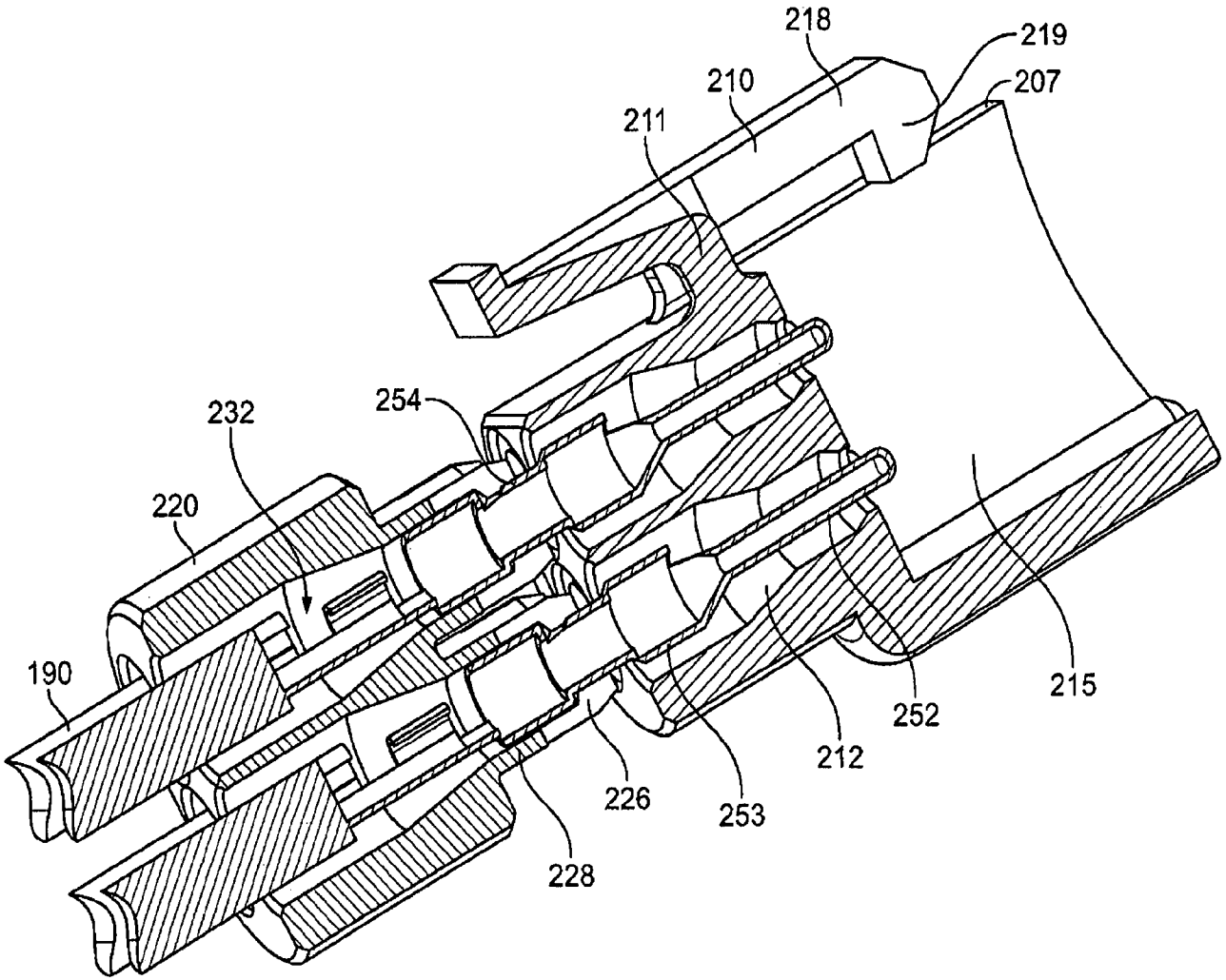
FIG. 4 illustrates a cross-sectional view of a pre-staged receptacle subassembly in accordance with an exemplary embodiment of the invention.

The cross-sectional view shown in FIG. 4 better shows how the fingers 226 of the parapets 228 retain the male contacts 250 in the pre-staged position upon returning to their biased position. The fingers 226 are configured to provide a diameter at the outlet of the rear receptacle aperture 232 such that the head section 253 of the contact 250 cannot freely slip back through the parapet 228, but that pulling with only a few pounds of force, about two to five pounds, is sufficient to overcome the retention force and thus remove the contact 250 from the rear receptacle housing 220. Thus, the contacts 250 are retained in position while subsequent contacts 250 are inserted into their respective apertures 232. If one or more contacts 250 are inserted into an improper aperture 232, the error can easily be corrected before the contacts 250 are locked into place for operation.

Thus, inserting the male contacts 250 in the pre-staged configuration accomplishes removably locking the male contacts 250 and their respective wires 190 in place to confirm proper alignment but also allows a range of torsional motion and twisting of the wires during pre-assembly.

Once the male contacts 250 have been inserted and confirmed to be at the proper location, the staging tabs 217 of the front receptacle housing 210 are adjusted to the final staging pad 224. The pre-staging pad 222 and the final staging pad 224 are separated by any distance such that moving the staging tabs 217 from the pre-staging pad 222 to the final staging pad 224 results in the parapets 228 moving from a position external the front receptacle aperture 212 in the pre-staged configuration to a position internal the front receptacle aperture 212 in the final staged configuration.

Figure 5:
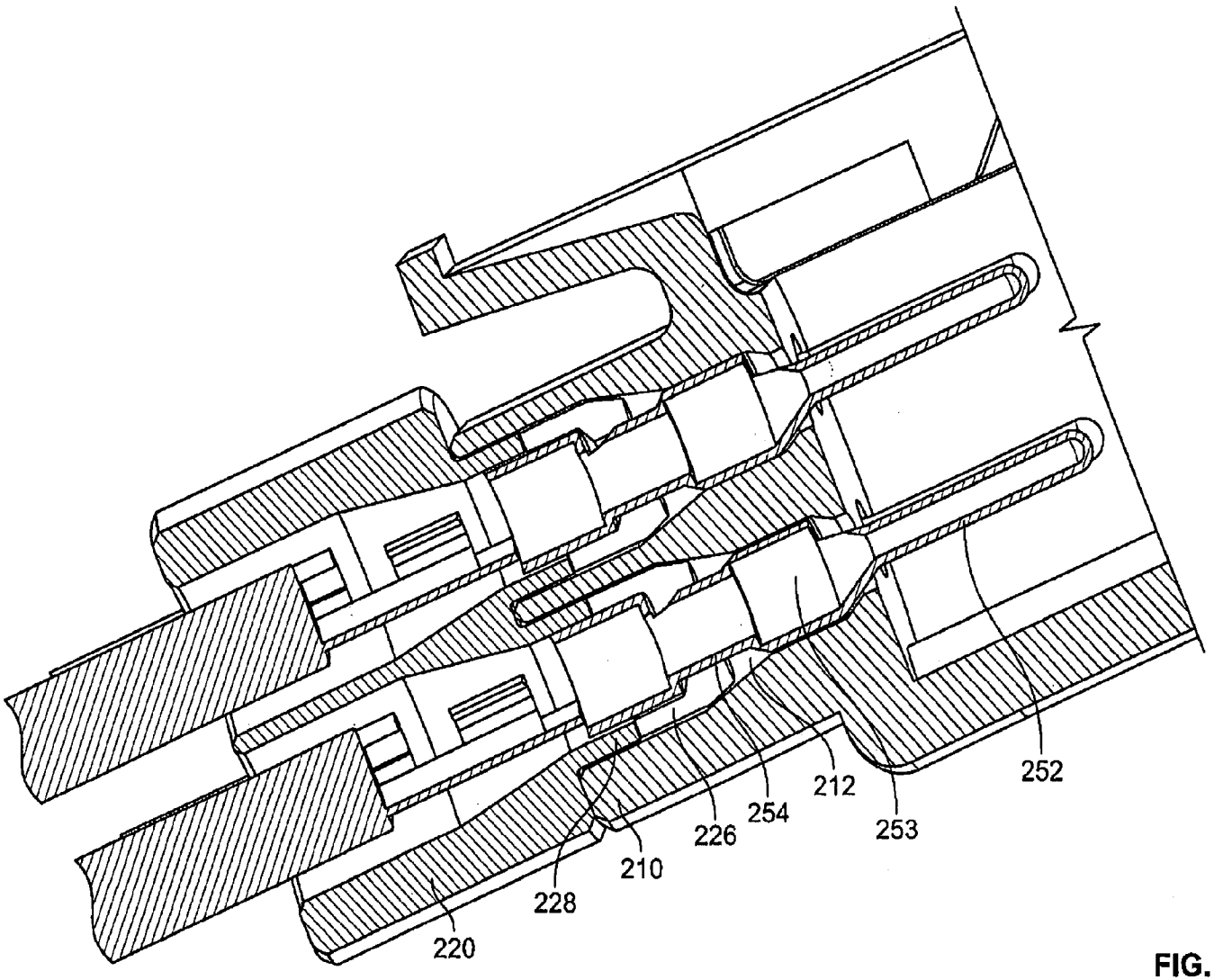
FIG. 5 illustrates a cross-sectional view of a fully-staged receptacle subassembly in accordance with an exemplary embodiment of the invention.

As a result, as seen in FIG. 5, when the staging tabs 217 are moved to the final staging pad 224, the parapets 228 are positioned within the front receptacle apertures 212 and expansion of the parapet fingers 226 is prevented by the internal walls that define the front receptacle aperture 212. Thus, the fingers 226 are no longer free to expand and substantially prevent removal of the male contacts 250 from the receptacle subassembly 200 under tensile forces less than about 15 pounds, more typically less than about 20 pounds, which are sufficiently large to accommodate levels of stress found in typical operating ranges (i.e., normal refrigerator door opening and closing).

Returning to FIG. 2 and the plug subassembly 100, the front plug housing 110 and the rear plug housing 120 are each formed from an insulative material to have a substantially cylindrical shape and are sized and dimensioned to be received within the receptacle subassembly 200 so that a mating face 105 of the plug subassembly 100 contacts the corresponding mating face 205 of the receptacle subassembly 200 when connected. Each of the front and rear plug housings 110, 120 include a plurality of contact-receiving apertures extending longitudinally through the plug subassembly 100 via front plug apertures 112 and rear plug apertures 132. The plug's contact receiving apertures are aligned to correspond with those of the receptacle subassembly such that the male and female contacts 250, 150 properly engage to form multiple continuous circuits when the connector assembly 5 is fully mated.

Figure 6:
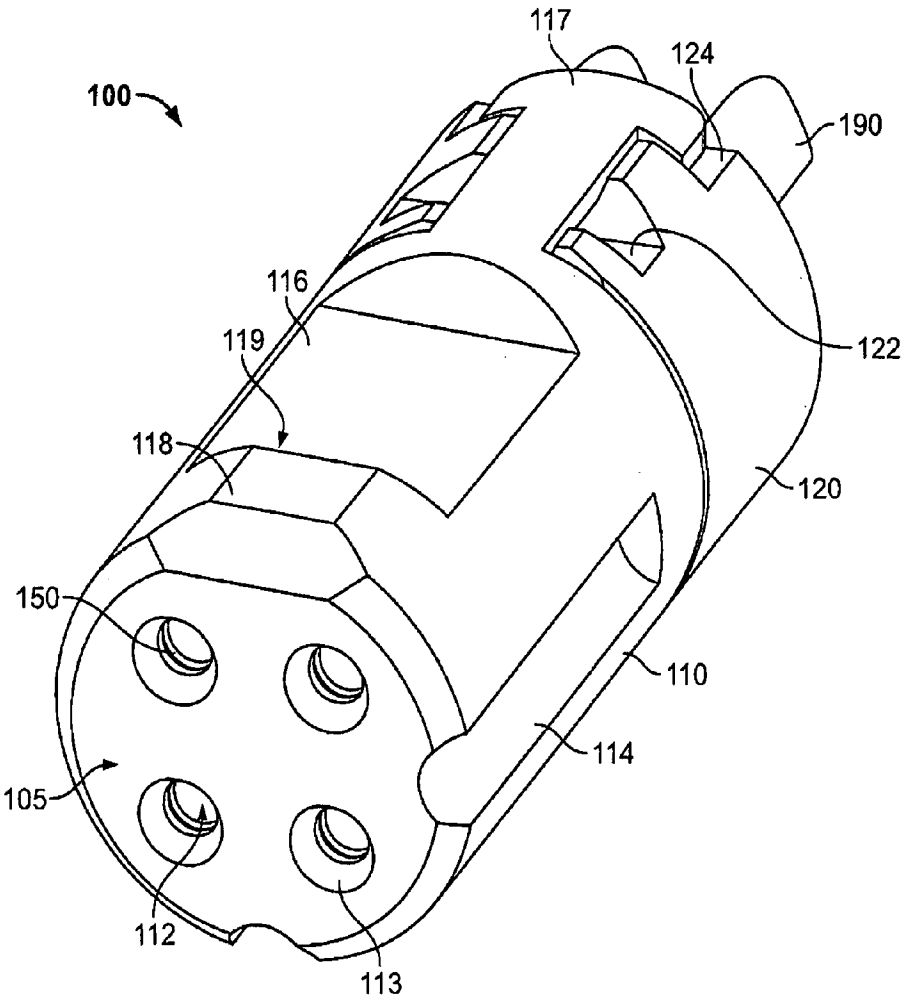
FIG. 6 illustrates a fully staged plug subassembly in accordance with an exemplary embodiment of the invention.

As better seen in FIG. 6, to better ensure alignment, the front plug housing 110 may be formed with at least one, and typically two or more, longitudinal groove(s) 114 extending rearwardly away from the plug mating face 105 and which are complementary to respective raised longitudinal rib(s) 214 extending into the plug-receiving channel 215 from the interior surface of the cylindrical wall 207. If included, the angular locations of the ribs 214 and the grooves 114 are preferably arranged to provide a polarizing feature for the mating of the front plug housing 110 and the front receptacle housing 210, and thus the plug subassembly 100 and the receptacle subassembly 200.

The abutment 118 is formed unitarily with the front plug housing 110 to extend radially outward, while a planar surface 116 extends rearwardly away from the abutment 118. The abutment 118 includes a rear wall 119 that is engaged by the hook portion 219 of the latch 218 when the connector assembly 5 is fully mated.

Female contacts 150 are disposed within the plug's contact receiving apertures. The female contacts 150 are similar to the male contacts 250 in that they also have a head section 153, a neck section 154 of smaller diameter than the head section 153, and a crimp section 156 for connecting with a wire 190. However, the forward mating end 152 of each of the female contacts 150 is formed so as to surround and engage the pins 252 of a respective male contact 250.

The female contacts 150 may be flush with the mating face 105 of the plug, but more typically are slightly recessed from the mating face 105. This prevents exposure of the female contacts 150 and thus protects them from possible damage during assembly. A slight taper or funnel 113 may further be provided in the mating face 105 of the front plug housing 110 for each front plug aperture 112 to direct the corresponding the male contact 250 into the female contact 150 when the connector assembly 5 is mated.

By providing cylindrical male and female contacts 150, 250, the contacts and the wires to which they are terminated can be rotated 360° within the apertures of their respective subassemblies in both the pre-staged and fully staged configurations, even when the subassemblies are fully mated. This rotation accommodates for and relieves torsional strain encountered when the connector assembly 5 is used with a refrigerator door when the door is opened and closed. As a result, the torque from door opening and closing doesn't fully transfer to the crimp point or cause other strain that might cause the contacts and wires to separate.

As illustrated, the plug subassembly 100 includes both a front housing 110 and a rear housing 120 having corresponding plug staging tabs 117 and two-position plug staging pads 122, 124 in a manner similar or identical to those of the receptacle subassembly 200. It will be appreciated, however, that in some embodiments it may be desirable to provide one multi-housing subassembly and one unitary housing subassembly.

In embodiments in which the receptacle subassembly 200 and plug subassembly 100 are both two piece housings, the rear receptacle housing 220 and the rear plug housing 120 may be identical, thereby reducing the number of components that must be separately machined and manufactured. Furthermore in such embodiments, the receptacle staging tabs 217 and staging pads 222, 224 may be disposed in a plane substantially orthogonal with that of the plug staging tabs 117 and staging pads 122, 124.

It will be appreciated that while different aspects of the invention have been discussed as having male or female configurations for achieving physical and/or electrical contact, the configurations could be reversed, or other types of configurations for mating two parts could be used instead.

While the foregoing specification illustrates and describes exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An electrical connector assembly for a refrigerator door comprising:

a substantially cylindrical plug subassembly having a front plug housing and a rear plug housing, the front plug housing and the rear plug housing positionable in a first staging configuration and a second staging configuration with respect to one another;

a substantially cylindrical receptacle subassembly mateably connectable with the plug subassembly; and means for releaseably mating the plug and receptacle subassemblies to one another, wherein the receptacle subassembly includes a common receptacle channel for receiving the plug subassembly, wherein a plurality of male contacts are disposed within the common receptacle channel, and wherein the plug subassembly includes a plurality of female contacts individually having a mating end positioned within separate plug channels, the female contacts comprising a head section, and a neck section having a diameter smaller than the head section, wherein each female contact is configured to connect with a corresponding male contact when the plug and receptacle are mateably connected and wherein the plug is sized and dimensioned to fit through a refrigerator door hinge, and wherein the rear plug housing comprises a plurality of multi-fingered parapets extending forwardly away from the rear plug housing toward the front plug housing retracted around the neck section of the female contact.

2. The electrical connector assembly of claim 1 wherein the receptacle subassembly includes a front receptacle housing and a rear receptacle housing, the front receptacle housing and the rear receptacle housing positionable in a first staging configuration and a second staging configuration with respect to one another.

3. The electrical connector assembly of claim 1 wherein the receptacle subassembly has at least one longitudinal rib extending radially into the common receptacle channel, the longitudinal rib corresponding a longitudinal groove in the plug subassembly.

4. The electrical connector assembly of claim 1 wherein the front plug housing has at least two staging tabs extending rearwardly toward the rear plug housing and wherein the rear plug housing has at least two staging pads associated with each staging tab, the staging pads recessed from the surface of the rear plug housing and configured to receive the staging tabs such that when the staging tabs are received in the first staging pad, the plug subassembly is in the first staging configuration and when the staging tabs are received in the second staging pad, the plug subassembly is in the second staging configuration.

5. The electrical connector assembly of claim 1 wherein the male contacts and the female contacts are substantially cylindrical and have a range of torsional motion of up to 360° in either one of a clockwise or counterclockwise direction.

6. The electrical connector assembly of claim 1 wherein a force in the range of about two to five pounds is sufficient to remove the female contacts from the plug subassembly when in the first staging configuration and wherein a force of about less than about fifteen pounds is insufficient to remove the female contacts from the plug subassembly when in the second staging configuration.

7. The electrical connector assembly of claim 1 wherein the mating end of the female contacts are recessed from a plug mating face of the plug subassembly.

8. An electrical connector assembly for a refrigerator door comprising:

a substantially cylindrical plug subassembly having a front plug housing and a rear plug housing;

a substantially cylindrical receptacle subassembly mateably connectable with the plug subassembly having a front receptacle housing and a rear receptacle housing, the front receptacle housing and the rear receptacle housing positionable in a first staging configuration and a second staging configuration with respect to one another; and means for releaseably mating the plug and receptacle subassemblies to one another, wherein the receptacle subassembly includes a common receptacle channel for receiving the plug subassembly, wherein a plurality of male contacts are disposed within the common receptacle channel, and wherein the substantially cylindrical receptacle subassembly includes a plurality of male contacts individually having a mating end positioned within separate plug channels, the male contacts comprising a head section and a neck section having a diameter smaller than the head section each male contact configured to connect with a corresponding female contact when the receptacle and plug are mateably connected and wherein the plug is sized and dimensioned to fit through a refrigerator door hinge, and wherein the rear plug housing comprises a plurality of multi-fingered parapets extending forwardly away from the rear plug housing toward the front plug housing retracted around the neck section of the female contact.

9. The electrical connector assembly of claim 8 wherein the front plug housing and the rear plug housing are positionable in a first staging configuration and a second staging configuration with respect to one another.

10. The electrical connector assembly of claim 8 wherein the receptacle subassembly has at least one longitudinal rib extending radially into the common receptacle channel, the longitudinal rib corresponding to a longitudinal groove in the plug subassembly.

11. The electrical connector assembly of claim 8 wherein the front receptacle housing has at least two staging tabs extending rearwardly toward the rear receptacle housing and wherein the rear receptacle housing has at least two staging pads associated with each staging tab, the staging pads recessed from the surface of the rear receptacle housing and configured to receive the staging tab such that when the staging tabs are received in the first staging pad, the receptacle subassembly is in the first staging configuration and when the staging tabs are received in the second staging pad, the receptacle subassembly is in the second staging configuration.

12. The electrical connector assembly of claim 8 wherein the male contacts and the female contacts are substantially cylindrical and have a range of torsional motion of up to 360° in either one of a clockwise or counterclockwise direction.

13. The electrical connector assembly of claim 8 wherein a force in the range of about two to five pounds is sufficient to remove the male contacts from the receptacle subassembly when in the first staging configuration and wherein a force of about less than about fifteen pounds is insufficient to remove the male contacts from the receptacle subassembly when in the second staging configuration.

14. The electrical connector assembly of claim 1 wherein the mating end of the female contacts are recessed from a plug mating face of the plug subassembly.

15. An electrical connector assembly for a refrigerator door comprising:

a substantially cylindrical plug subassembly having a front plug housing and a plug receptacle housing, the front plug housing and the rear plug housing positionable in a first staging configuration and a second staging configuration with respect to one another;

a substantially cylindrical receptacle subassembly mateably connectable with the plug subassembly having a front receptacle housing and a rear receptacle housing, the front receptacle housing and the rear receptacle housing positionable in a first staging configuration and a second staging configuration with respect to one another; and means for releaseably mating the plug and receptacle subassemblies to one another, wherein the receptacle subassembly includes a common receptacle channel for receiving the plug subassembly, wherein a plurality of male contacts are disposed within the common receptacle channel, and wherein the plug subassembly includes a plurality of female contacts individually having a mating end positioned within separate plug channels, the female contacts comprising a head section, and a neck section having a diameter smaller than the head section, and wherein the substantially cylindrical receptacle subassembly includes a plurality of male contacts individually having a mating end positioned within separate plug channels, the male contacts comprising a head section, and a neck section having a diameter smaller than the head section, and wherein each female contact is configured to connect with a corresponding male contact when the plug and receptacle are mateably connected and wherein the plug is sized and dimensioned to fit through a refrigerator door hinge, and wherein the rear receptacle housing comprises a plurality of multi-fingered parapets extending forwardly away from the rear receptacle housing toward the front receptacle housing retracted around the neck section of the female contact, and wherein the rear plug housing comprises a plurality of multi-fingered parapets extending forwardly away from the rear plug housing toward the front plug housing retracted around the neck section of the female contact.

16. The electrical connector assembly of claim 15 wherein the front plug housing has at least two plug staging tabs extending rearwardly toward the rear plug housing and wherein the rear plug housing has at least two plug staging pads associated with each plug staging tab, the plug staging pads recessed from the surface of the rear plug housing and configured to receive the plug staging tab such that when the plug staging tabs are received in the first plug staging pad, the plug subassembly is in the first plug staging configuration and when the plug staging tabs are received in the second plug staging pad, the plug subassembly is in the second plug staging configuration, and wherein the front receptacle housing has at least two receptacle staging tabs extending rearwardly toward the rear receptacle housing and wherein the rear receptacle housing has at least two receptacle staging pads associated with each receptacle staging tab, the receptacle staging pads recessed from the surface of the rear receptacle housing and configured to receive the receptacle staging tabs such that when the receptacle staging tabs are received in the first receptacle staging pad, the receptacle subassembly is in the first receptacle staging configuration and when the receptacle staging tabs are received in the second receptacle staging pad, the receptacle subassembly is in the second receptacle staging configuration.

17. The electrical connector assembly of claim 15 wherein the plug staging tabs are in a plane orthogonal to the receptacle staging tabs.

18. The electrical connector assembly of claim 15 wherein the receptacle subassembly has at least one longitudinal rib extending radially into the common receptacle channel, the longitudinal rib corresponding to a longitudinal groove in the plug subassembly.

19. The electrical connector assembly of claim 15 wherein the rear plug housing and the rear receptacle housing are geometrically identical.

20. The electrical connector assembly of claim 15 wherein the male contacts are removably retained in the receptacle subassembly in the first staging configuration and are fixedly retained in the receptacle subassembly in the second staging configuration, and wherein the female contacts are removably retained in the plug subassembly in the first staging configuration and are fixedly retained in the plug subassembly in the second staging configuration.

* * * * *